US009400003B2

(12) United States Patent
Kim et al.

(10) Patent No.: US 9,400,003 B2
(45) Date of Patent: Jul. 26, 2016

(54) HYDRAULIC PUMP CONTROL SYSTEM FOR CONSTRUCTION MACHINERY

(75) Inventors: Mi-Ok Kim, Changwon-si (KR); Sang-Ho Bang, Changwon-si (KR)

(73) Assignee: VOLVO CONSTRUCTION EQUIPMENT AB (SE)

( * ) Notice: Subject to any disclaimer, the term of this patent is extended or adjusted under 35 U.S.C. 154(b) by 388 days.

(21) Appl. No.: 13/989,110

(22) PCT Filed: Nov. 30, 2010

(86) PCT No.: PCT/KR2010/008501

§ 371 (c)(1),
(2), (4) Date: May 23, 2013

(87) PCT Pub. No.: WO2012/074145

PCT Pub. Date: Jun. 7, 2012

(65) Prior Publication Data

US 2013/0239560 A1 Sep. 19, 2013

(51) Int. Cl.
*E02F 9/22* (2006.01)
*F15B 15/18* (2006.01)
(Continued)

(52) U.S. Cl.
CPC ..... *F15B 15/18* (2013.01); *E02F 9/123* (2013.01); *E02F 9/2235* (2013.01); *E02F 9/2285* (2013.01); *E02F 9/2296* (2013.01); *F15B 13/0422* (2013.01)

(58) Field of Classification Search
CPC ..... F15B 2211/20553; F15B 2211/851; F15B 13/0422; F15B 15/18; E02F 9/2282; E02F 9/2296; E02F 9/2235
See application file for complete search history.

(56) References Cited

U.S. PATENT DOCUMENTS

2005/0229594 A1* 10/2005 Nanjo et al. ..... 60/484
2009/0159143 A1* 6/2009 Nishikawa et al. ..... 137/625.64

FOREIGN PATENT DOCUMENTS

CN 86106816 A 5/1987
JP H04250227 A 9/1992
(Continued)

OTHER PUBLICATIONS

International Search Report (in Korean and English) and Written Opinion (in Korean) for PCT/KR2010/008501, mailed Aug. 26, 2011; ISA/KR.
(Continued)

*Primary Examiner* — Michael Leslie
*Assistant Examiner* — Abiy Teka
(74) *Attorney, Agent, or Firm* — Harness, Dickey & Pierce, P.L.C.

(57) ABSTRACT

Disclosed is a hydraulic pump control system for minimizing flow loss by optimally limiting the discharge flow volume of the hydraulic pump when an upper swivel body is made to swivel abruptly. The hydraulic pump control system according to the present invention comprises: a swivel motor which is connected to a hydraulic pump; a control spool for the swivel motor, which controls the hydraulic fluid supplied to the swivel motor during switch back by means of a control signal for a remote control valve; an orifice which is provided on the furthest downstream side of a center bypass pathway; a regulator which controls the angle of inclination of the swash plate of the hydraulic pump; a swivel operation signal detection means which detects a swivel operation signal output from the remote control valve; an electronic proportional pressure reducing valve which outputs a secondary pressure proportional to the detection signal of the swivel operation signal detection means; and a shuttle valve of which the input sides are respectively coupled to the orifice and the electronic proportional pressure reducing valve, and the output side is coupled to the regulator.

1 Claim, 2 Drawing Sheets

(51) Int. Cl.
*E02F 9/12* (2006.01)
*F15B 13/042* (2006.01)

(56) References Cited

FOREIGN PATENT DOCUMENTS

| | | | |
|---|---|---|---|
| JP | H04300402 | A | 10/1992 |
| JP | H06264901 | A | 9/1994 |
| JP | 10-077661 | A | 3/1998 |
| JP | 2002021808 | A | 1/2002 |
| JP | 2002129602 | A | 5/2002 |
| JP | 2004028264 | A | 1/2004 |
| JP | 2005060970 | A | 3/2005 |
| JP | 2006-290561 | A | 10/2006 |
| JP | 2008039063 | A | 2/2008 |
| JP | 2011021694 | A | 2/2011 |
| JP | 2012007656 | A | 1/2012 |
| KR | 10-2003-0058378 | A | 7/2003 |
| KR | 10-2005-0049767 | A | 5/2005 |
| KR | 10-2005-0119762 | A | 12/2005 |
| KR | 100964113 | B1 | 6/2010 |

OTHER PUBLICATIONS

International Preliminary Report on Patentability (Chapter II) (in Korean) for PCT/KR2010/008501, dated Feb. 27, 2013; IPEA/KR.

Office Action issued in corresponding Chinese Patent Application No. 2010800703030 (5 pages).

Office Action issued in corresponding Japanese Patent Application No. 2013-541879 (5 pages).

* cited by examiner

HYDRAULIC PUMP CONTROL SYSTEM FOR CONSTRUCTION MACHINERY

FIELD OF THE INVENTION

The present invention relates to a system for controlling a hydraulic pump for a construction machine, in which when swing an upper swing structure is swingably rotated with respect to a lower traveling structure of a construction machine such as an excavator or the like, the discharge flow rate of the hydraulic pump can be reduced in an operation period during which the maximum flow rate of a hydraulic fluid discharged from the hydraulic pump is not required.

More particularly, the present invention relates to a hydraulic pump control system for a construction machine, in which when an upper swing structure is abruptly swingably rotated with respect to a lower traveling structure of the construction machine, the discharge flow rate of the hydraulic pump is limited optimally so that a loss in the flow rate of a hydraulic fluid discharged from the hydraulic pump can be minimized while securing the swing acceleration to the maximum.

BACKGROUND OF THE INVENTION

Figure 1:
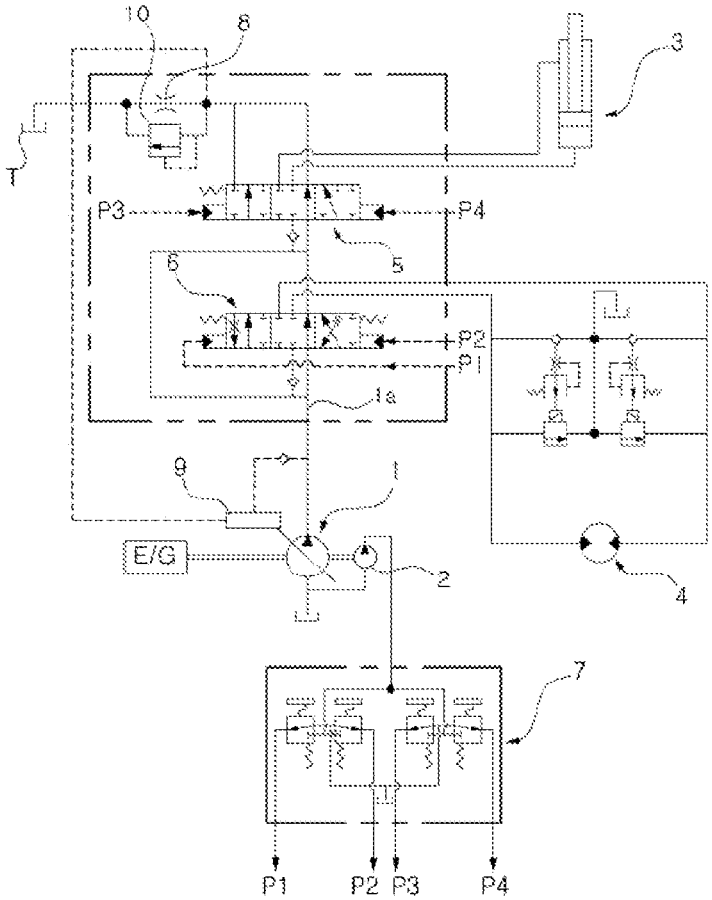
Fig. 1 PRIOR ART

A hydraulic pump control system for a construction machine according to the prior art as shown in FIG. 1 includes:

a variable displacement hydraulic pump (hereinafter, referred to as "hydraulic pump") 1 and a pilot pump 2, which are connected to an engine;

a boom cylinder 3 and a swing motor 4, which are connected to and driven by the hydraulic pump 1;

control valves 5 and 6 that is installed in a center bypass path 1*a* of the hydraulic pump 1 and controls a start, a stop, and a direction change of the boom cylinder 3 and the swing motor 4 during shifting, respectively;

a remote control valve (RCV) 7 that supplies pilot signal pressures P3, P4, P1 and P2 to the control valves 5 and 6 to drive the boom cylinder 3 and the swing motor 4;

an orifice 8 that is installed on the lowermost stream side of the center bypass path 1*a* to generate a negative signal pressure; and a regulator 9 that receives the signal pressure generated from the orifice 8 and controls a swivel angle of a swash plate of the hydraulic pump 1 to control a discharge flow rate of the hydraulic pump 1.

In the hydraulic pump control system for a construction machine as constructed above, the control valve 6 is shifted by the pilot signal pressures P1 and P2 supplied from the pilot pump 2 by manipulating the remote control valve 7, so that a hydraulic fluid discharged from the hydraulic pump 1 can be transferred to the swing motor 4 via the control valve 6 to drive the swing motor 4 to cause the upper swing structure to be swingably rotated with respect to the lower traveling structure.

In addition, the manipulation of the remote control valve 7 causes the control valve 5 to be shifted by the pilot signal pressures P3 and P4 supplied from the pilot pump 2, so that the hydraulic fluid discharged from the hydraulic pump 1 can be transferred to the boom cylinder 3 via the control valve 5 to drive the boom cylinder 3 to upward or downward move the boom.

In this case, the flow rate of the hydraulic fluid discharged from the hydraulic pump 1 is in proportional to a manipulation angle or a pilot signal pressure of the remote control valve 7 irrespective of a load pressure generated from a work apparatus such as a boom or the like. For this reason, if a lever of the remote control valve 7 is manipulated with a full stroke or a set pilot signal pressure exceeds a predetermined pressure, the hydraulic pump 1 discharges the hydraulic fluid at the maximum flow rate.

If an operator manipulates the remote control valve 7 abruptly to drive the swing motor 4, the flow rate of the hydraulic fluid discharged from the hydraulic pump 1 is increased in proportional to a manipulation amount of a swing manipulation lever to cause the upper swing structure to swingably rotated at a sudden acceleration with respect to the lower traveling structure. That is, the flow rate of the hydraulic fluid supplied to the swing motor 4 initially starts from "0" and is increased gradually until the swing motor 4 starts to be accelerated at its stop state and is increased in a swing speed.

Meanwhile, when the upper swing structure starts to be swingably rotated abruptly with respect to the lower traveling structure, all the hydraulic fluids corresponding to a difference between a hydraulic fluid of a flow rate sucked by rotation of the swing motor 4 and a hydraulic fluid of a flow rate discharged from the hydraulic pump 1 is returned to a hydraulic tank T through a relief valve 10 to protect the swing motor 4 and the swing structure. That is, if the hydraulic fluid of the flow rate discharged from the hydraulic pump 1 is increased to cause a discharge pressure of the hydraulic fluid to exceed a predetermined pressure of the relief valve 10, a hydraulic fluid of a flow rate other than a hydraulic fluid of the flow rate used to rotate the swing motor 4 is returned to the hydraulic tank T.

Figure 2:
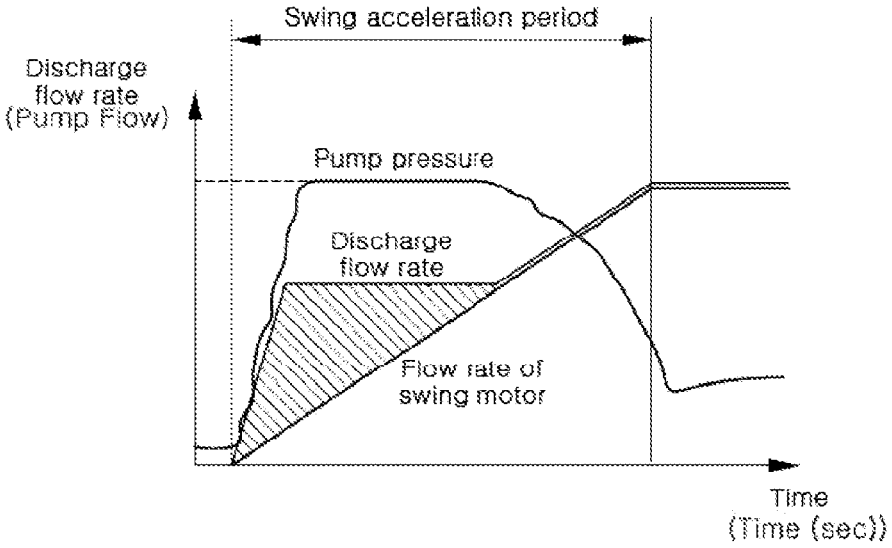
Fig. 2 PRIOR ART

As shown in FIG. 2, a high flow rate of a hydraulic fluid is not required in an operation period from a time point when the upper swing structure starts to swing to a time point when the upper swing structure is accelerated. On the other hand, since the hydraulic pump 1 discharges the maximum flow rate of a hydraulic fluid, there occurs a problem in that a flow rate loss (i.e., a shaded region in FIG. 2) is caused, and the amount of fuel consumed by the engine is increased to decrease the fuel efficiency of the equipment.

DETAILED DESCRIPTION OF THE INVENTION

Technical Problems

Accordingly, the present invention was made to solve the aforementioned problem occurring in the prior art, and it is an object of the present invention to provide a hydraulic pump control system for a construction machine, in which when an operator manipulates the remote control valve abruptly to swing an upper swing structure with respect to a lower traveling structure of the construction machine, the discharge flow rate of the hydraulic pump is limited optimally so that a loss in the flow rate of a hydraulic fluid discharged from the hydraulic pump can be minimized until the upper swing structure is accelerated while securing the swing acceleration to the maximum.

Technical Solution

To accomplish the above object, in accordance with an embodiment of the present invention, there is provided a hydraulic pump control system for a construction machine, including:

a variable displacement hydraulic pump and a pilot pump, which are connected to an engine;

a swing motor connected to and driven by the hydraulic pump;

a control spool installed in a center bypass path of the hydraulic pump and configured to control a start, a stop, and a direction change of the swing motor during shifting;

a remote control valve configured to supply a pilot signal pressure for shifting to the control spool to drive the swing motor;

an orifice installed on the lowermost stream side of the center bypass path to generate a negative signal pressure;

a regulator configured to receive the signal pressure generated from the orifice and control a swivel angle of a swash plate of the hydraulic pump to control a discharge flow rate of the hydraulic pump;

a swing manipulation signal detection means configured to detect a swing manipulation signal outputted from the remote control valve and output a detection signal;

a control unit configured to output a control signal to the regulator in response to the detection signal inputted thereto from the swing manipulation signal detection means to reduce the discharge flow rate of the hydraulic pump;

an electro proportional pressure reducing valve configured to generate a secondary pressure that is in proportion to the detection signal of the swing manipulation signal detection means, which is inputted thereto from the control unit; and a shuttle valve having an input side connected to the orifice and the electro proportional pressure reducing valve and an output side connected to the regulator, and configured to supply a higher pressure of the signal pressure generated from the orifice and the secondary pressure generated from the electro proportional pressure reducing valve to the regulator.

According to a more preferable embodiment, if the detection signal of the swing manipulation signal detection means is increased over a predetermined change rate or the discharge flow rate of the hydraulic pump predicted based on the detection signal of the swing manipulation signal detection means is increased over the predetermined change rate, the control unit outputs the control signal to the electro proportional pressure reducing valve so that the discharge flow rate of the hydraulic pump is limited to the predetermined change rate and thus the flow rate of a hydraulic fluid supplied to the swing motor is reduced.

Advantageous Effect

The hydraulic pump control system for a construction machine according to an embodiment of the present invention as constructed above has the following advantages.

When an upper swing structure is swingably rotated with respect to a lower traveling structure, the discharge flow rate of the hydraulic pump is limited in a specific control period from a time point when the upper swing structure starts to swing by receiving a swing manipulation signal to a time point when the upper swing structure is accelerated, and thus the flow rate of a hydraulic fluid supplied to the swing motor is reduced, thereby minimizing a flow rate loss and reducing the amount of fuel consumed by the engine to increase the fuel efficiency of the equipment.

BRIEF DESCRIPTION OF THE INVENTION

Figure 3:
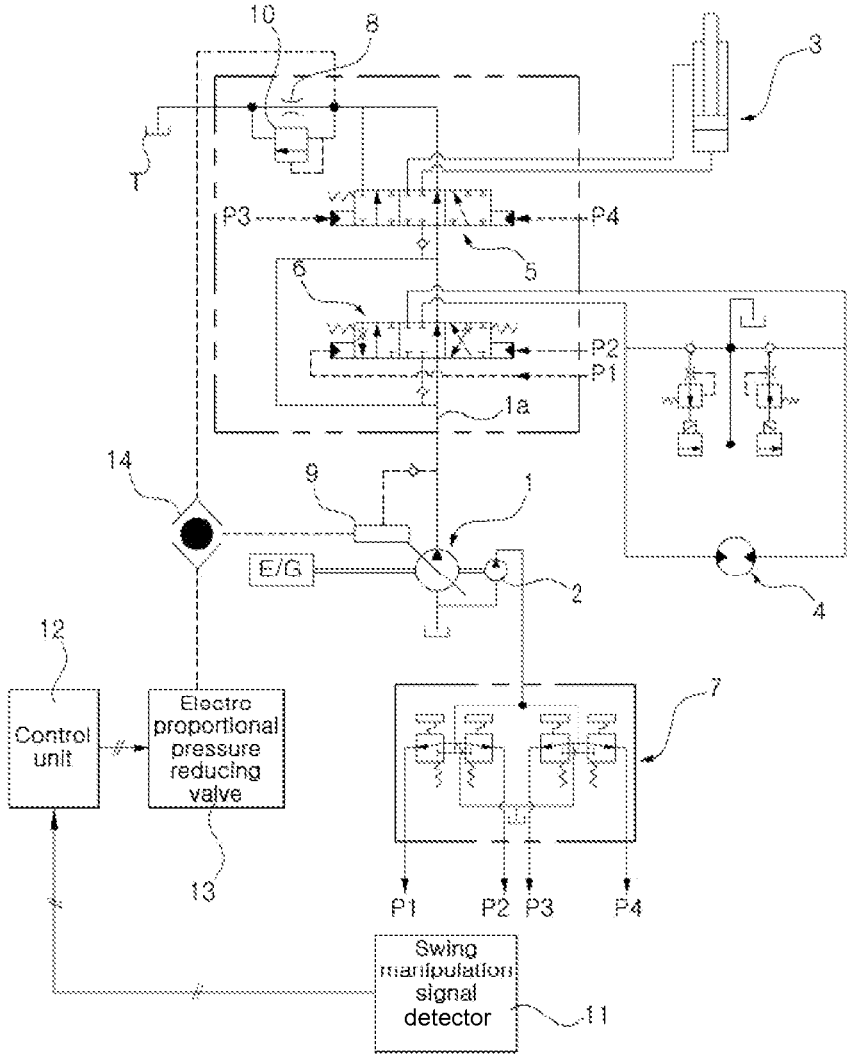

The above objects, other features and advantages of the present invention will become more apparent by describing the preferred embodiments thereof with reference to the accompanying drawings, in which:

FIG. 1 is a hydraulic circuit diagram of a hydraulic pump control system for a construction machine in accordance with the prior art;

FIG. 2 is a graph illustrating the relationship between the discharge flow rate of a hydraulic pump and the pressure for the swing operation in the hydraulic pump control system for a construction machine in accordance with the prior art; and FIG. 3 is a hydraulic circuit diagram of a hydraulic pump control system for a construction machine in accordance with an embodiment of the present invention;

EXPLANATION ON REFERENCE NUMERALS OF MAIN ELEMENTS IN THE DRAWINGS

1: variable displacement hydraulic pump
2: pilot pump
3: boom cylinder
4: swing motor
5, 6: control valve
7: remote control valve (RCV)
8: orifice
9: regulator
10: relief valve
11: swing manipulation signal detection means
12: control unit (V-ECU)
13: electro proportional pressure reducing valve (PPRV)
14: shuttle valve

PREFERRED EMBODIMENTS OF THE INVENTION

Hereinafter, preferred embodiments of the present invention will be described in detail with reference to the accompanying drawings. The matters defined in the description, such as the detailed construction and elements, are nothing but specific details provided to assist those of ordinary skill in the art in a comprehensive understanding of the invention, and thus the present invention is not limited to the embodiments disclosed hereinafter.

As shown in FIG. 3, the hydraulic pump control system for a construction machine according to an embodiment of the present invention includes:

a variable displacement hydraulic pump (hereinafter, referred to as "hydraulic pump") 1 and a pilot pump 2, which are connected to an engine;

a swing motor 4 that is connected to and driven by the hydraulic pump 1;

a control valve 6 that is installed in a center bypass path 1*a* of the hydraulic pump 1 and controls a start, a stop, and a direction change of the swing motor 4 during shifting;

a remote control valve (RCV) 7 that supplies pilot signal pressures P1 and P2 for shifting to the control valve 6 to drive the swing motor 4;

an orifice 8 that is installed on the lowermost stream side of the center bypass path 1*a* to generate a negative signal pressure;

a regulator 9 that receives the signal pressure generated from the orifice 8 and controls a swivel angle of a swash plate of the hydraulic pump 1 to control a discharge flow rate of the hydraulic pump 1;

a swing manipulation signal detection means 11 that detects a swing manipulation signal outputted from the remote control valve 7 and outputs a detection signal;

a control unit (V-ECU) 12 that outputs a control signal to the regulator 9 in response to the detection signal inputted thereto from the swing manipulation signal detection means 11 to reduce the discharge flow rate of the hydraulic pump 1;

an electro proportional pressure reducing valve (PPRV) 13 that is generates a secondary pressure that is in proportion to the detection signal of the swing manipulation signal detection means 11, which is inputted thereto from the control unit 12; and a shuttle valve 14 that has an input side connected to the orifice 8 and the electro proportional pressure reducing valve 13 and an output side connected to the regulator 9, and supplies a higher pressure of the signal pressure generated from the orifice 8 and the secondary pressure generated from the electro proportional pressure reducing valve 13 to the regulator 9.

If the detection signal of the swing manipulation signal detection means 11 is increased over a predetermined change rate or the discharge flow rate of the hydraulic pump 1 predicted based on the detection signal of the swing manipulation signal detection means 11 is increased over the predetermined change rate, the control unit 12 outputs the control signal to the electro proportional pressure reducing valve 13 so that the discharge flow rate of the hydraulic pump 1 is limited to the predetermined change rate and thus the flow rate of a hydraulic fluid supplied to the swing motor is reduced. In the drawings, a non-explained reference numeral 5 denotes a control valve that is installed in the center bypass path 1*a* of the hydraulic pump 1 and controls a start, a stop, and a direction change of a boom cylinder 3 during shifting in response to the pilot signal pressures P1 and P2 generated from the remote control valve 7.

Hereinafter, a use example of the hydraulic pump control system for a construction machine according to an embodiment of the present invention will be described in detail with reference to the companying drawings.

As shown in FIG. 3, when a remote control valve 7 is manipulated to swing an upper swing structure with respect to a lower traveling structure of a construction machine such as an excavator or the like, pilot signal pressures P1 and P2 discharged from the pilot pump 2 is supplied to the control valve 6 via the remote control valve 7 to shift the internal spool.

Thus, a hydraulic fluid discharged from the hydraulic pump 1 is supplied to the swing motor 4 via the control valve 6 to drive the swing motor 4 so that upper swing structure can be swingably rotated in a left or right direction.

Meanwhile, if an operator manipulates the remote control valve 7 abruptly, a detection signal detected by the swing manipulation signal detection means 11 is applied to the control unit 12.

Accordingly, the control unit 12 generates a control signal for controlling the regulator 9 for application to the electro proportional pressure reducing valve 13 to control the discharge flow rate of the hydraulic pump 1 in response to the detection signal applied thereto from the swing manipulation signal detection means 11.

That is, if the detection signal of the swing manipulation signal detection means 11 is increased over a predetermined change rate or the discharge flow rate of the hydraulic pump 1 predicted based on the detection signal of the swing manipulation signal detection means 11 is increased over the predetermined change rate, the control unit 12 outputs a proper electric current value to the electro proportional pressure reducing valve 13 so that the discharge flow rate of the hydraulic pump 1 is limited to the predetermined change rate and thus the flow rate of the hydraulic fluid supplied to the swing motor 4 is reduced.

Then, a secondary pressure that is in proportion to the detection signal of the swing manipulation signal detection means 11 is generated from the electro proportional pressure reducing valve 13 and is supplied to the shuttle valve 14.

In the meantime, the abrupt manipulation of the remote control valve 7 by the operator causes the amount of the hydraulic fluid discharged from the hydraulic pump 1 to be increased, so that a signal pressure generated from the orifice 8 installed on the lowermost stream side of the center bypass path 1*a* is supplied to the shuttle valve 14.

Thus, a relatively high pressure of the signal pressure generated from the orifice 8 and the secondary pressure generated from the electro proportional pressure reducing valve 13 is supplied to the regulator 9.

As described above, if s the remote control valve 7 is manipulated abruptly by the operator, the regulator 9 is driven according to a signal pressure inputted thereto in response to a swing manipulation signal indicative of the manipulation of the remote control valve 7. That is, the discharge flow rate of the hydraulic pump 1 is limited through the control of a swivel angle of a swash plate of the hydraulic pump 1 in a specific control period from a time point when the upper swing structure starts to swing by receiving the swing manipulation signal to a time point when the upper swing structure is accelerated, and thus the flow rate of a hydraulic fluid supplied to the swing motor 4 is reduced, thereby minimizing a flow rate loss.

INDUSTRIAL APPLICABILITY

In the hydraulic pump control system for a construction machine according to an embodiment of the present invention as constructed above, even in the case where an operator manipulates the remote control valve 7 abruptly to swing an upper swing structure with respect to a lower traveling structure of the construction machine, That is, the discharge flow rate of the hydraulic pump 1 is limited during a predetermined time period (e.g., 2 to 3 seconds) from a time point when the upper swing structure starts to swing by receiving the swing manipulation signal to a time point when the upper swing structure is accelerated, and thus the flow rate of a hydraulic fluid supplied to the swing motor 4 is reduced, thereby minimizing a flow rate loss and reducing the amount of fuel consumed by the engine to increase the fuel efficiency of the equipment.

The invention claimed is:

1. A hydraulic pump control system for a construction machine for minimizing hydraulic fluid flow loss when an upper swivel body of the construction machine is made to swivel abruptly, comprising:

a variable displacement hydraulic pump and a pilot pump, which are connected to an engine;

a swing motor connected to and driven by the hydraulic pump;

a control spool along a center bypass path of the hydraulic pump, the control spool configured to shift to control a start, a stop, and a direction change of the swing motor;

a remote control valve configured to supply a pilot signal pressure to the control spool to shift the control spool and drive the swing motor;

an orifice installed on a lowermost stream side of the center bypass path to generate a negative signal pressure;

a regulator configured to: receive the negative signal pressure generated by the orifice; and control a swivel angle of a swash plate of the hydraulic pump to control a discharge flow rate of the hydraulic pump;

a swing manipulation signal detector configured to: detect a swing manipulation signal output from the remote control valve; and output a detection signal based on the swing manipulation signal;

a control unit configured: to receive the detection signal from the swing manipulation signal detector; and output a control signal to the regulator based on the detection signal, the control signal configured to reduce the discharge flow rate of the hydraulic pump;

an electro proportional pressure reducing valve configured to generate a secondary pressure proportionate to the detection signal;

a shuttle valve including: a first input connected to the orifice for receipt of the negative signal pressure; a second input connected to the electro proportional pressure reducing valve for receipt of the secondary pressure; and an output connected to the regulator;

wherein:

if the detection signal is greater than a predetermined change rate, or if a predicted discharge flow rate of the hydraulic pump based on the detection signal is greater than the predetermined change rate, the control unit outputs the control signal to the electro proportional pressure reducing valve so that the discharge flow rate of the hydraulic pump is limited to the predetermined change rate, thereby reducing the flow rate of hydraulic fluid supplied to the swing motor from a time point when the upper swivel body starts to swing after detection of the swing manipulation signal, to when the upper swivel body is accelerated in order to minimize hydraulic fluid flow loss; and the shuttle valve is configured to supply the higher one of the negative signal pressure versus the secondary pressure to the regulator to control the discharge flow rate of the hydraulic pump.

* * * * *